US005590784A

United States Patent [19]

Daniels

[11] Patent Number: 5,590,784

[45] Date of Patent: Jan. 7, 1997

[54] HEADER BAG DISPENSING COMBINATION

[75] Inventor: Mark E. Daniels, Redondo Beach, Calif.

[73] Assignee: The Avantage Group, Inc., Redondo Beach, Calif.

[21] Appl. No.: 499,086

[22] Filed: Jul. 6, 1995

[51] Int. Cl.[6] ..... B65D 30/10; B65D 33/14

[52] U.S. Cl. ..... 206/554; 206/815

[58] Field of Search ..... 383/8, 9, 200, 383/207; 206/554, 815

[56] References Cited

U.S. PATENT DOCUMENTS 4,476,979 10/1984 Reimann et al. ..... 206/554

5,062,716 11/1991 Conrad et al. ..... 206/554 X 5,469,969 11/1995 Huang ..... 206/554

*Primary Examiner*—Jacob K. Ackun

*Attorney, Agent, or Firm*—Beehler & Pavitt

[57] ABSTRACT

A combination of a single or double hook-mounted pack of header bags in which, to facilitate removal of each bag, there is provided along the perforation line separating each bag header from the remainder of the bag, at least one elongated opening, such as a chisel cut. This enables one to practice the method of bag removal which involves simply placing the fingers below, or in the area of the elongated opening, and pressing the fingers down against the bag pack, thereby to separate the front wall of the bag from its back wall and pull the front wall away from the bag's back wall to open the bag for filling by the clerk's other hand.

11 Claims, 4 Drawing Sheets

Fig. 1
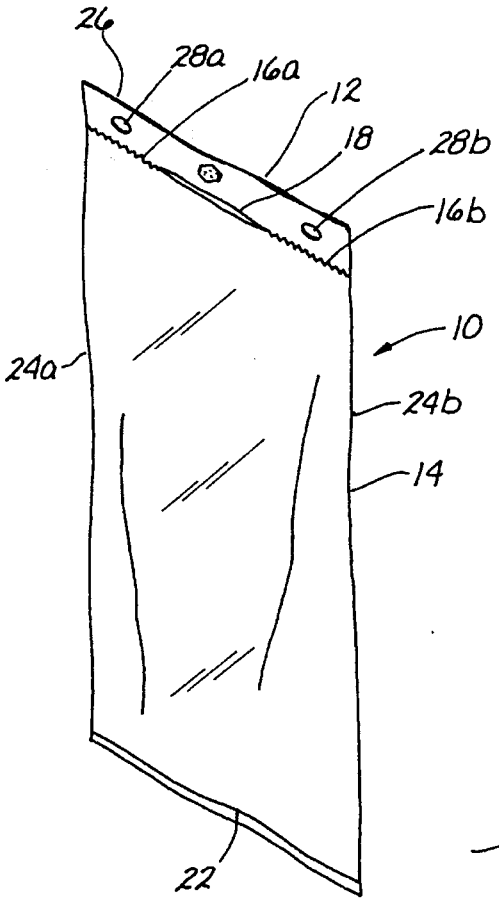
Fig. 2
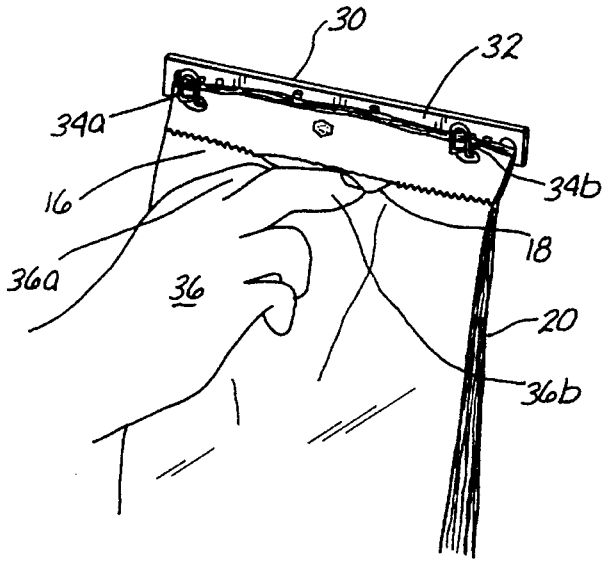
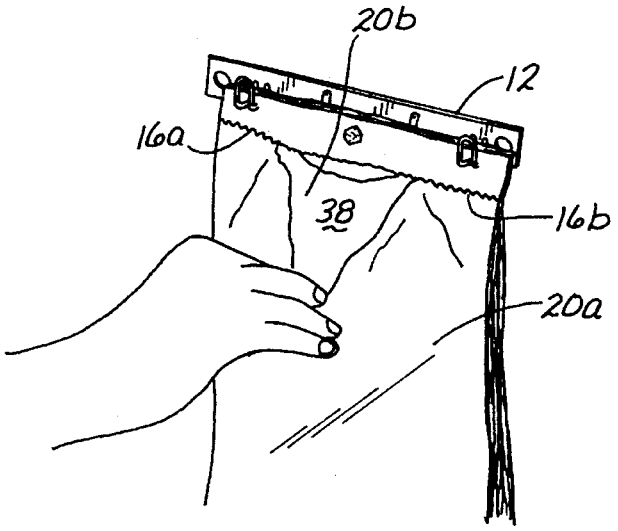
Fig. 3

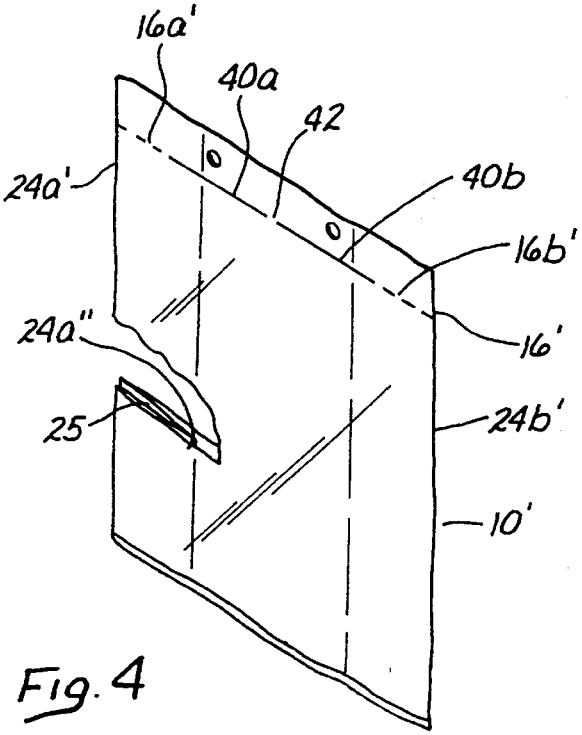
Fig. 4
Fig. 5
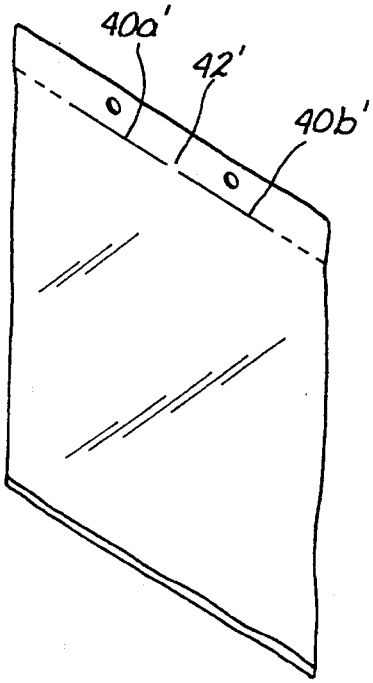
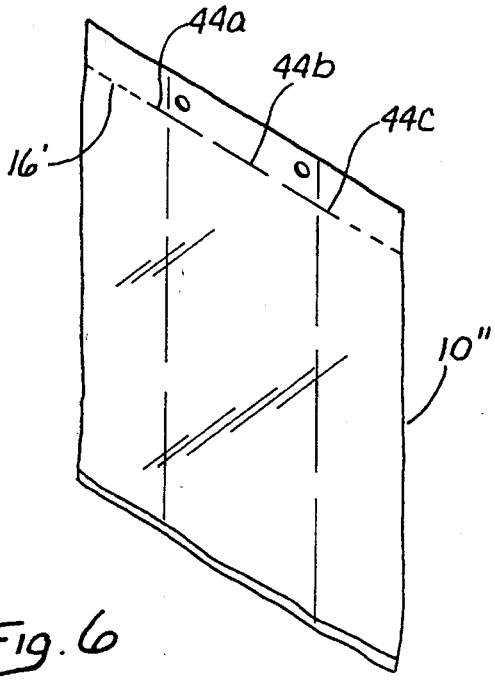
Fig. 6
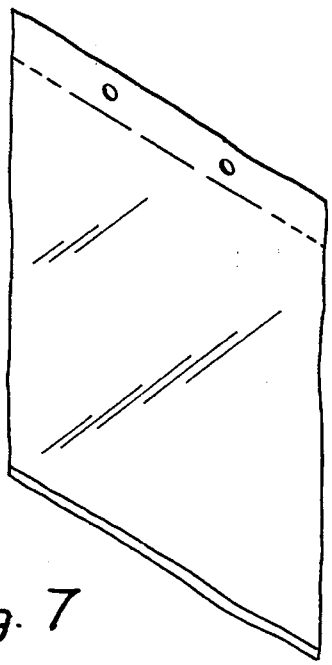
Fig. 7

HEADER BAG DISPENSING COMBINATION

FIELD OF THE INVENTION

This invention relates generally to the field of plastic shopping bags and, particularly, to the dispensing of that class of bags which are known as merchandise bags on "headers" or "header bags".

BACKGROUND OF THE INVENTION

Description of the Prior Art

Header bags are a well known type of bags. They are ordinarily rectangular in shape, usually having a narrower width than length. The bags are closed at their sides usually having been fabricated from plastic tubing, and may either have plain edges or may be gusseted along their sides, i.e. the actual flattened edge is pushed inward for some distance between the two side panels of the bags to present two new edges between which is the original edge, and all three edges are then pressed together to result in gussets disposed between the original edge and the two new edges.

The header bags may be sealed together at the upper ends as well as at their bottom ends, but each bag will have a rupturable perforation line which is spaced from, and extends parallel to, the top edge of the bag. The strip between the rupturable perforation line and the top edge of the bag pack is known as the "header". Packs of these header bags are formed by disposing as many as a hundred bags, one on top of the other in a coinciding relationship, with the header of each bag being adhered to the header of adjacent bags. The bags are mounted in some way to hold the headers in a fixed position leaving the remainder of each bag free of any restraint other than that provided by its perforated connection to the header. Among the ways of mounting the headers is providing registering orifices on the headers and at least one peg or hook on a rack or other fixed planar surface on which the rack, if provided, itself may be secured.

Heretofore, removal of such header bags from thus mounted packs has been accomplished by a cashier or packer grasping with one hand the edge of a bag below the perforation line and pulling the lower part of the bag free from the header by, in effect, tearing the bag along the perforation line. It is then necessary to grasp the bag with the user's other hand to open it by pulling apart the upper edges of the bag panels. When this separation has been accomplished, the cashier or packer may then deposit the customer's purchases in the thus opened bag.

While the dispensing process for header bags is theoretically simple and efficient, there are certain problems which have arisen which cause a waste of personnel time and sometimes the use of larger than necessary bags for particular purchases. Among such problems are the fact that there may be difficulty in grasping the edge of just one bag of the pack at a time, particularly where the bags are slippery. Not infrequently, the cashier or other packer may end up pulling two or more bags from the headers, one or more of which may be discarded, or may inadvertently fall upon the floor.

In addition, after a bag has been pulled from its header by the cashier's grasping an edge, it is ordinarily necessary for the cashier then to use his or her other hand to pull apart the bag panels so that merchandise may be deposited in the bag cavity—particularly since bag panels often tend to stick together, making the process of opening the bags more difficult.

Similar problems occur where header bags are laid down inside dispenser cartons or on shelves. In addition, in certain types of weather, static build-up may occur which can make it most difficult for a cashier to remove one bag at a time.

In addition, these problems particularly occur where small sized bags are provided, with the result that cashiers or other packers find it easier to reach and pull out bags which are larger than necessary for a particular customer's purchases. Such over-bagging, particularly when repeated thousands of times, results in costly waste.

In effect, to overcome such problems with the header bags just described, certain other expedients have been utilized, one of which is what is termed "front open" header bags. With front open header bags, the front panel of each bag does not extend over the perforation line through the rear panel so that the bags are open on the header pack. A clerk may thus extract a bag from a mounted pack by simply placing his or her hand at the top edge of the front panel and pulling it away from the back panel, both to open the bag end, with further pulling, remove it from the header above the perforation line of the back panel of the bag. This open header bag arrangement, however, has been found to be unsatisfactory for, and consequently, is seldom employed, for thin bags, e.g. those having wall thicknesses less than 0.0006 inch. Since bag wall thicknesses are often desired to be even less than half 0.0006", in order to reduce their cost, the open header bag system cannot be employed. Also, open headers cannot be employed with gusseted bags, and the production process by which they are made is relatively slow, thereby increasing their costs.

What has been needed is a system and method for encouraging the use of correct bag sizes for all purchases and for improving the efficiency of cashiers and other packagers, and accomplishing such objectives at a minimum cost and with bags which can be of any suitable wall thickness, and with the option of having gussets to facilitate packing various products' configurations.

SUMMARY OF THE INVENTION

The present invention overcomes the problems described above which are found in prior art systems by providing packs of "header bags" in which at least one elongated opening, such as can be made by a chisel cut, is provided along the perforation line extending between the bags and their headers.

Where a bag pack is mounted on a rack having one or more hooking elements spaced apart from each other, either a single chisel cut may be made along the perforation line, preferably at its center; or a plurality of cuts may be made with the cuts being spaced from each other by a part of the perforation line, or even a smaller rupturable bridge.

Where chisel cuts are provided in accordance with the present invention, removal of bags one at a time from the header pack is greatly facilitated. To effect such removal, the store clerk or other person involved in removing and packing a bag with merchandise, simply places his or her fingers against the bag in the area of a chisel cut and presses them against the bag and moves the fingers downwardly. The result is an immediate separation of the front bag wall from the rear bag wall to initiate the opening of the bag thus contacted, followed by a rupture of the perforations on either side of the chisel cut on the front bag wall and resulting in pulling the latter away from the rear bag wall to open the bag. Further pulling of the front wall of the bag causes a rupture of the chisel cut and perforations separating the rear back wall from the header. All this is done with one hand so that the clerk may immediately use his other hand to place articles in the opened bag which has been thus drawn from the pack. The embodiments herein described may be utilized where the bags are being hung vertically from a single hook, or two or more hooks, or where the hook protrudes upwardly from a shelf on which the bag pack may be disposed. Also, while a chisel cut or cuts are preferred, the separation may be only a slit or slits cut along the perforation line.

While it is contemplated that the hooking elements ordinarily will extend horizontally outwardly from a vertical hanging surface, the present invention is equally applicable to an arrangement where the hooking element or elements project upwardly from a shelf on which the bag pack may be at least partially supported.

The present invention thus offers labor saving in removal and packing of bags, and material saving in that a proper bag size may be more easily and conveniently selected when several different sized bag packs are mounted in the area of the check-out counter, either vertically or horizontally.

DESCRIPTION OF THE DRAWINGS

In the accompanying drawings,

FIG. 1 is a perspective view of a header bag formed in accordance with the present invention.

FIG. 2 illustrates the manner in which header bags of the type of FIG. 1 may be mounted on a rack and removed in accordance with the method of the present invention.

FIG. 3 is a perspective view similar to that of FIG. 1, but showing the immediate sequence of removing the bag from the mounted pack.

FIG. 4 is a perspective view partially cut away showing a gusseted header bag with two chisel cuts in accordance with the present invention.

FIG. 5 is a perspective view similar to FIG. 4 but showing two chisel cuts supplied to a non-gusseted bag.

FIG. 6 is a perspective view of a gusseted bag having three chisel cuts.

FIG. 7 is a view similar to FIG. 6 showing a non-gusseted bag.

DESCRIPTION OF THE PREFERRED EMBODIMENT

Figure 8:
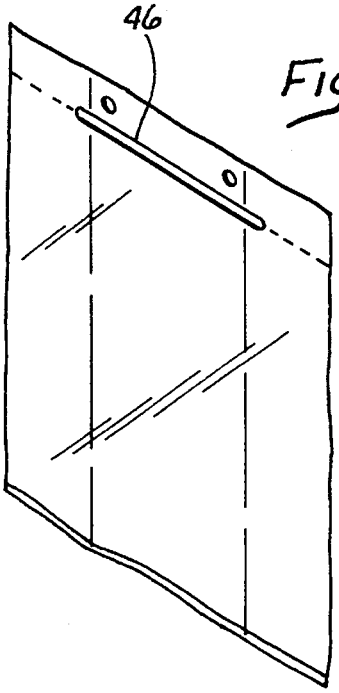
FIG. 8 is a perspective view of a gusseted bag being formed with an elongated oval channel between the bag and the header.
Figure 9:
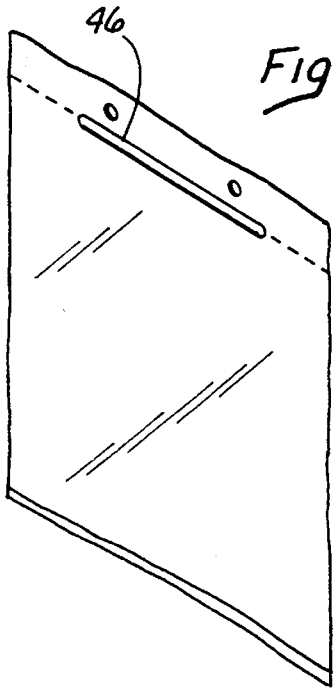
FIG. 9 is a view similar to FIG. 8 but showing a non-gusseted bag.
Figure 10:
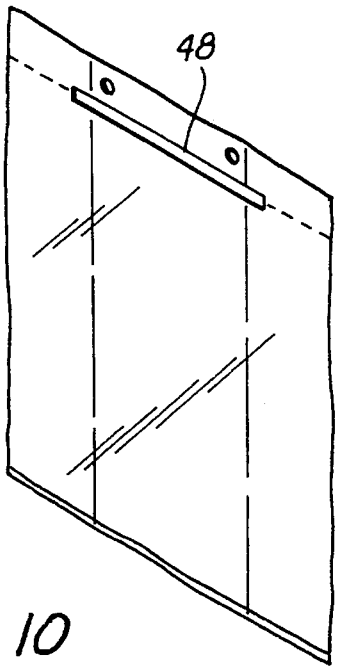
FIG. 10 is a view similar to FIG. 8 but showing a gusseted bag formed with a rectangular slot between the center of the bag and the header.
Figure 11:
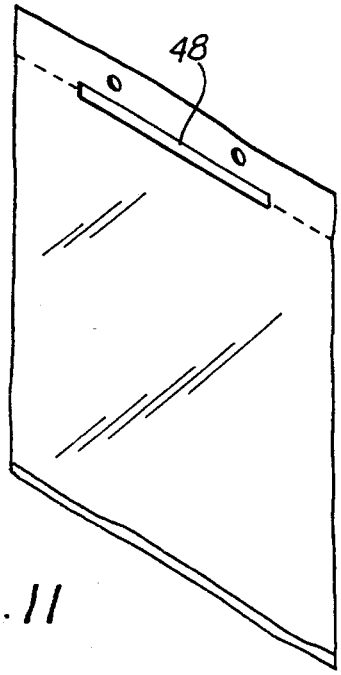
FIG. 11 is a view similar to FIG. 10 but showing a non-gusseted bag.

Referring to FIGS. 1 through 3, there is shown in FIG. 1 a header bag 10 formed with a header 12 and a bag body 14. The bag body 14 is joined to the header 12 along a perforation line 16*a*, 16*b*, which line is centrally interrupted by a chisel cut or slit 18. Header bags of this type may be formed of a front panel 20*a*, and a rear panel 20*b*, with the panels being joined along their bottom edges 22 and side edges 24*a* and 24*b*, as well as along their upper header edges 26. Mounting holes 28*a*, 28*b* may be provided through the header portions 12 of the bags. Packs of such header bags 20 may be mounted on a rack 30 which may comprise a transverse plate 32 from which project a pair of hooking elements 34*a* and 34*b*. When the headers 12 are mounted on the rack, the hooking elements 34*a*, 34*b* are passed through the holes 28*a*, 28*b* respectively in the pack of headers 12. A pack of header bags 10 may thus appear as shown in FIGS. 2 and 3.

It is a feature of the present invention that when the bags 10 are formed, some type of opening such as the chisel cut 18 is provided along the perforation line 16 thereby to create at least two segments 16*a*, 16*b* of that line which are separated from each other by the chisel cut 18.

In use, one or two fingers 36*a*, 36*b* of a user's hand 36 are moved across the chisel cut 18 and drawn downwardly and outwardly in the manner shown in FIG. 2, thereby to cause the front panel 20*a* to begin detaching along the perforation segments 16*a*, 16*b*. This results in opening the first bag 10 and, with further pulling away from the header 12, the rear bag panel 20*b* is detached from its own pair of perforation segments (not shown), but which coincide with the perforation segment 16*a*, 16*b* of the front panel 20*a*. The first bag is thus removed from the header pack with an open mouth 38. The process may be repeated until all of the bags have been detached from their headers.

While a single chisel cut is shown in FIGS. 1–3 and has been described and discussed above, the present invention may assume a number of other different forms as illustrated in FIGS. 4–11.

Thus, in FIG. 4, a pair of chisel cuts 40*a* and 40*b* are shown spaced from each other by a small attachment 42 to keep the bag 10' from sagging. In this FIG. 4 embodiment, the perforations 16*a*', 16*b*' extend inwardly from the side edges 24*a*', 24*b*' of the upper portions of the bags, but only to the beginning of the two chisel cuts 40*a*, 40*b*. As shown in the cut-away portion of FIG. 4, the bag 10' is of the type known as a gusseted bag, i.e. a bag in which the true edge 24*a*", for example, has been folded inwardly and the fold 25 flattened.

FIG. 5 is similar to FIG. 4 except that the bag shown is not gusseted. However, it is provided with two chisel cuts 40*a*' and 40*b*' in the same manner as is illustrated and described in connection with FIG. 4.

In FIG. 6 three chisel cuts 44*a*, 44*b* and 44*c* have been made along the perforation line 16' in the gusseted bag 10". FIGS. 8 through 11 inclusive illustrate both gusseted and nongusseted bags which, in the case of FIGS. 8 and 9, may be formed with oval slots 46 and, in the case of FIGS. 10 and 11, rectangular slots 48.

In all of these illustrated embodiments of the invention, removal of the bags from their headers is accomplished in the same manner as was shown in FIGS. 2 and 3. Where a plurality of chisel cuts, such as shown in FIGS. 4–7, or the bags are formed with slotted openings 46, 48, as shown in FIGS. 8–11, the removal of the bags from their headers may be facilitated. It may be preferred, however, in order to prevent sagging of the bags to provide chisel cuts in the manner shown in FIGS. 4–7 whereby connections 42, 42' are left along the perforation line 16'.

Figure 12:
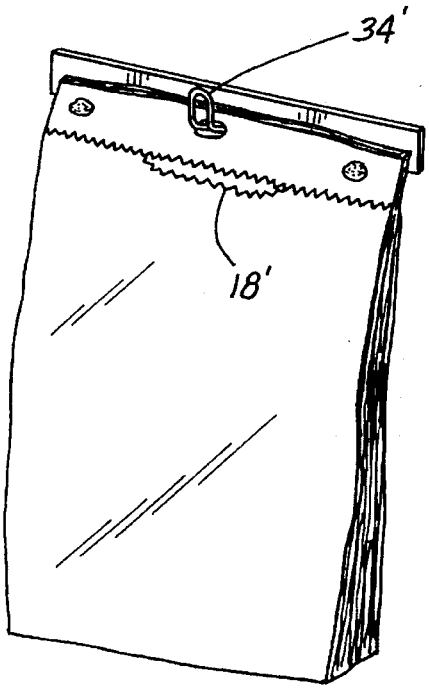
FIG. 12 shows an embodiment of the invention applied to a header bag pack mounted on a single hook rack.
Figure 13:
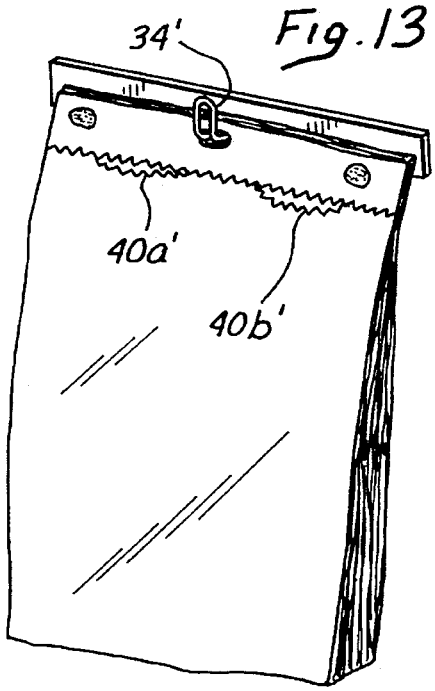
FIG. 13 is similar to FIG. 12, but two chisel cuts are provided in the bag pack.

FIGS. 12 and 13 illustrate the application of the present invention to a bag pack which may be mounted on a single hooking element 34'. As may be seen, in FIG. 12, only a single chisel cut 18' has been made, as in the FIGS. 1–3 embodiment In FIG. 13, two cuts 40*a*', 40*b*' are provided so that one is on each side of the hook 34'. Whether one or two chisel cuts are provided, removal of the bag is accomplished in the same manner as where the bags are mounted on two hooks as described in reference to FIGS. 1–11.

Figure 14:
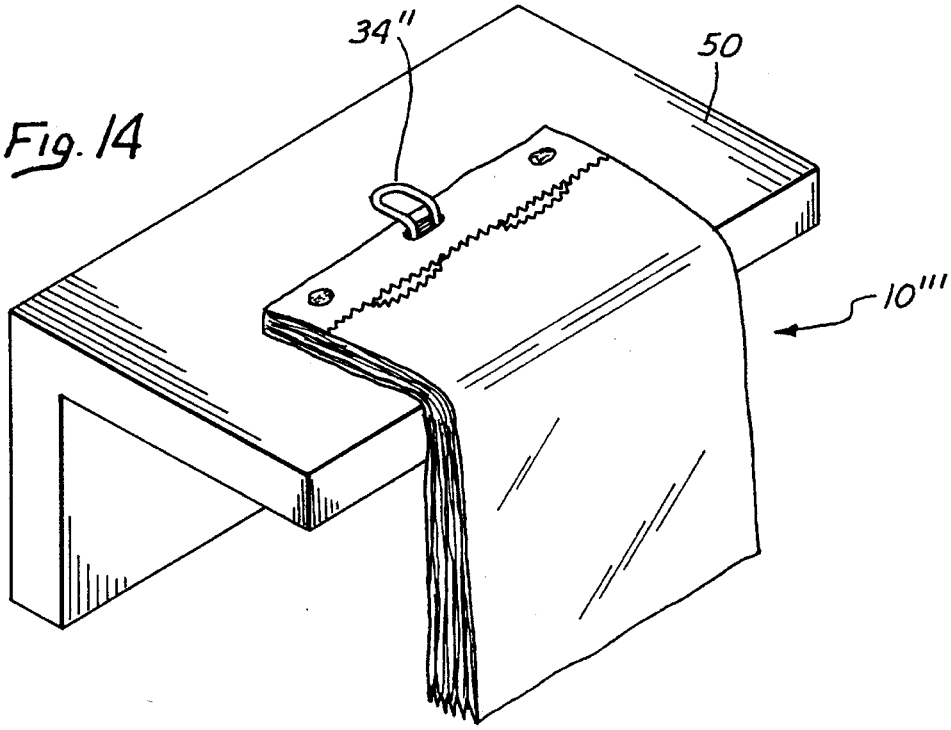
FIG. 14 illustrates the mounting of a bag pack similar to that of FIG. 13 on a hook disposed on a horizontal shelf.

FIG. 14 illustrates an embodiment of the invention in which a horizontal shelf 50 is provided with a single hooking element 34" on which the bag pack 10" is hooked and partially supported by the shelf 50. This embodiment could be employed where a horizontal shelf is provided below the check-out counter.

From the foregoing and the illustrations referred to, it will be appreciated by those skilled in the art that the present invention offers a system which enables header-type bags to be more easily removed from their packs and the principle of the invention may be applied to many variations of header bags, such as those shown in FIGS. 1–13, inclusive.

I claim:

1. The combination of mounting means and a pack of coinciding plastic header bags, the mounting means comprising a pair of supported parallel hooking elements spaced from each other by a first predetermined distance and projecting upwardly in a common plane; and each of the bags of the pack of header bags, being formed of a pair of coinciding separate rectangular panels closed at their sides and at their bottom edges and perforated transversely along at least a portion of a line spaced from and parallel to its top edge, said perforations extending inwardly from each side of the bag for a second predetermined distance terminating at a point spaced from the termination of the other perforation by a third predetermined distance, and at least one elongated opening being provided along said perforation line and disposed between the terminations of said inwardly extending perforations, the portion of the bag defined by the perforation line and the upper edge of the header being orificed at two points spaced apart from each other by said first predetermined distance, thereby permitting the bags of the bag pack to be mounted on the hooking elements, and the last said portion of each bag being adhered to the similar portion of each adjacent bag in the pack.

2. The combination of hooking elements and pack of plastic header bags as defined in claim 1 wherein two elongated openings are spaced apart from each other are provided along the perforation line to leave a rupturable strip between the adjacent ends of the openings.

3. The combination as described in claim 1 wherein the elongated opening is a chisel cut.

4. The combination as described in claim 1 wherein the hooking elements are affixed to, and supported by, a fixedly positioned horizontal rack member.

5. The combination as described in claim 1 wherein the hooking elements are supported and protrude upwardly from a horizontal surface, said surface extending laterally away from the hooking element to an edge and on which surface at least a portion of the pack of bags is laid and supported.

6. The method of dispensing header bags from a pack of such bags, said method comprising:

A) Providing a pack of bags secured in coincidence with each other, each of said bags being formed of a pair of coinciding separate rectangular panels closed at its sides and at its bottom edges and perforated transversely along at least a portion of a line spaced from, and parallel to, the top edge of the bag, said perforations extending inwardly from each side of the bag for a first predetermined distance terminating at a point spaced from the termination of the other perforation by a second predetermined distance; and having at least one elongated opening along said line and disposed between, and spaced from, the terminations of said inwardly extending perforations, the portion of each bag defined by the perforation line and the upper edge of the bag being orificed at two points spaced apart from each other by a third predetermined distance;

B) Providing a pair of supported parallel hooking elements spaced from each other by said third predetermined distance and projecting upwardly in a common plane;

C) Mounting the pack of header bags on the hooking elements, thereby to allow the bag pack to extend from said elements; and D) Placing one or more fingers of a hand against the outer panel of the outermost bag of the pack at its at least one elongated opening, drawing the fingers against and down from said opening; and pulling the outermost panel away from the hooking elements, thereby to open the bag by separating the outermost panel from its adjacent panel along the perforation line and, with further pulling of the outermost panel, separating the last said adjacent panel from the front panel of the ensuing adjacent bag, upon the rupture of the perforations of the said adjacent panel.

7. The combination of mounting means and a pack of coinciding plastic header bags, the mounting means comprising a supported hooking element projecting upwardly; and each of the bags of the pack of header bags being formed of a pair of coinciding separate rectangular panels closed at their sides and at their bottom edges and perforated transversely along at least a portion of a line spaced from and parallel to its top edge, said perforations extending inwardly from each side of the bag for a first predetermined distance terminating at a point spaced from the termination of the other perforation by a second predetermined distance, and at least one elongated opening being provided along said perforation line and disposed between the terminations of said inwardly extending perforations, the portion of the bag defined by the perforation line and the upper edge of the bag being orificed at a point intermediate the side edges of the bag, thereby permitting the bags of the bag pack to be mounted on the hooking element, and the last said portion of each bag being adhered to the similar portion of each adjacent bag in the pack.

8. The combination of hooking element and pack of plastic header bags as defined in claim 7 wherein two elongated openings are provided, spaced from each other, one on each side of the bag orifice, along the perforation line to leave a rupturable strip between the adjacent ends of the openings.

9. The combination as described in claim 1 wherein the elongated opening is a chisel cut.

10. The combination as described in claim 1 wherein the hooking element is affixed to, and supported by, a fixedly positioned horizontal rack.

11. The method of dispensing header bags from a pack of such bags, said method comprising:

A) Providing a pack of bags secured in coincidence with each other, each of said bags being formed of a pair of coinciding separate rectangular panels closed at their sides and at their bottom edges and perforated transversely along at least a portion of a line spaced from, and parallel to, the top edge of the bag, said perforations extending inwardly from each side of the bag for a first predetermined distance terminating at a point spaced from the termination of the other perforation by a second predetermined distance; and having at least one elongated opening along said line and disposed between, and spaced from, the terminations of said inwardly extending perforations, the portion of each bag defined by the perforation line and the upper edge of the bag being orificed at a point intermediate its side edges;

B) Providing a supported hooking element projecting upwardly;

C) Mounting the pack of header bags on the hooking element, by pushing the hooking element into the orifice intermediate the side edges of the portions of the bags defined by the perforation lines and upper edges of the bags, thereby to allow the bag pack to extend from said element; and D) Placing one or more fingers of a hand against the outer panel of the outermost bag at its at least one elongated opening, drawing the fingers against and down from said opening; and pulling the outermost panel from its adjacent panel along the perforation line and, with further pulling of the outermost panel, separating the last said adjacent panel from the front panel of the ensuing adjacent bag, upon the rupture of the perforations of the said adjacent panel, thereby presenting a bag opened and ready to load.

* * * * *